United States Patent [19]

Smith

[11] Patent Number: 4,530,273

[45] Date of Patent: Jul. 23, 1985

[54] ROOF VENTILATOR

[76] Inventor: Robert L. Smith, 303 E. Bridge St., Blackwell, Okla. 74631

[21] Appl. No.: 599,072

[22] Filed: Apr. 11, 1984

[51] Int. Cl.[3] ..... F24F 7/02

[52] U.S. Cl. ..... 98/42.01; 98/42.23

[58] Field of Search ..... 98/29, 42 R, 66 R, 122

[56] References Cited

U.S. PATENT DOCUMENTS

| | | | |
|---|---|---|---|
| 1,502,944 | 7/1924 | Earhart | 98/42 R |
| 1,931,066 | 10/1933 | Eckert | 98/31 |
| 2,277,982 | 3/1942 | Hosbein | 98/42 R |
| 4,325,290 | 4/1982 | Wolfert | 98/42 A |

*Primary Examiner*—Harold Joyce

*Attorney, Agent, or Firm*—John A. Hamilton

[57] ABSTRACT

A roof ventilator consisting of a conduit adapted to be secured in a hole formed through roof deck to extend upwardly therefrom, the conduit including a first perforated section extending through a hole formed in layered roofing material applied over the deck, a second section adapted to seal the hole in the roofing material, a third section extending to any desired height above the roof, and a header providing downwardly directed air outlets to the atmosphere. A drip pan is suspended in the attic space below the roof deck to collect and dispose of moisture either condensing in the conduit, or expelled from the layered roofing material.

4 Claims, 3 Drawing Figures

ROOF VENTILATOR

Figure 1:
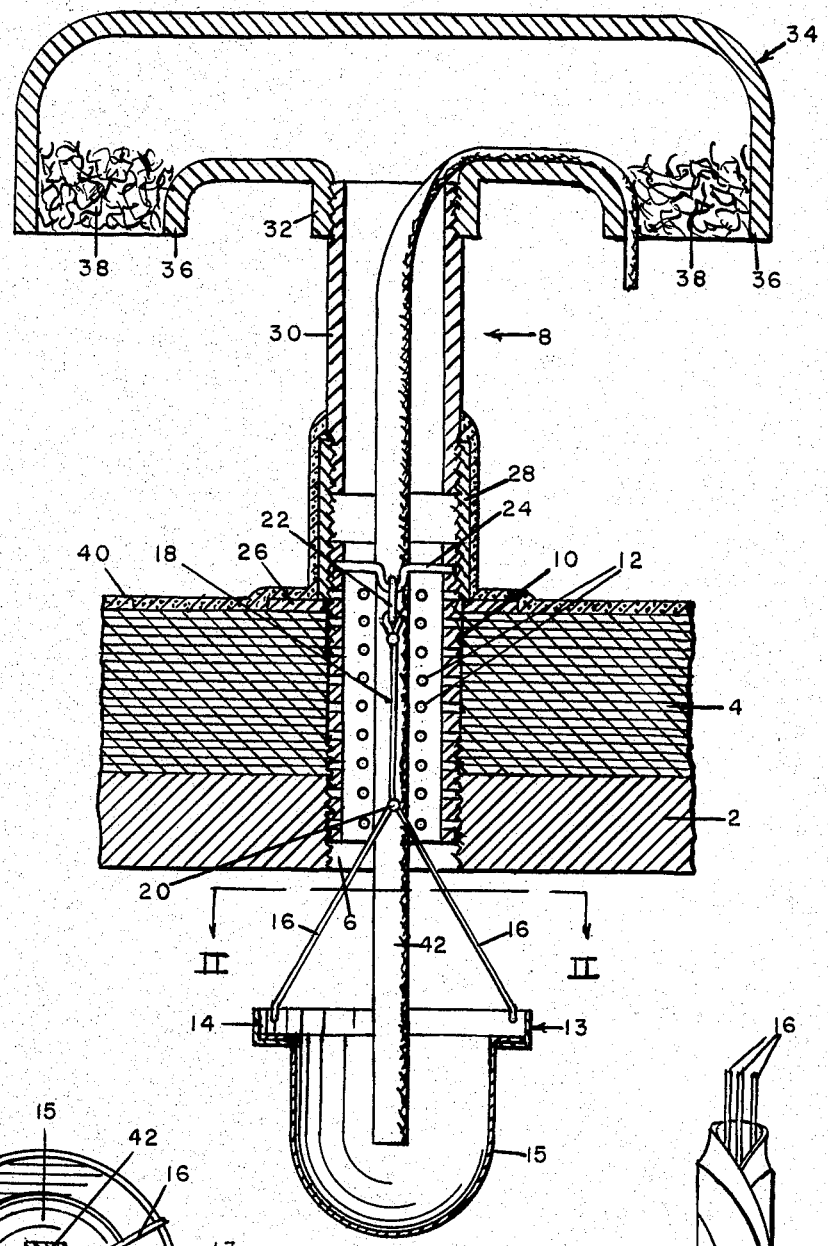

This invention relates to new and useful improvements in roof ventilators, and has particular reference to a ventilator which performs not only the usual function of allowing the escape of overheated air from the attic space between the roof and interior ceilings to atmosphere, but also of allowing the escape to atmosphere of gases forming between the layers of the roofing material itself.

It is of course already common practice to use attic ventilators consisting of conduits interconnected through the roof into the attic space between the roof and interior ceilings, and communicating with the outside atmosphere. In hot weather, such ventilators allow the escape of overheated attic air, improving comfort levels in the building interior, and decreasing the load imposed on air conditioning systems.

However, another common roofing problem arises when the roof deck is covered with a layered roofing material applied thereover. Such roofing materials usually consist of a number of alternating layers of roofing felt and a bituminous material such as asphalt or the like. The felt layers of course contain air and water vapor, and during construction of the roof, the material may be exposed to rain and weather, so that more moisture is absorbed. When such material is then applied over a roof deck, and sealed by a layer of tar or the like applied thereover, the air and moisture is trapped. When the roof is later subjected to high temperatures, as in warm weather in direct sunlight, the trapped air expands, and the trapped moisture vaporizes, often creating substantial gas pressure between the plies of the roofing. Pockets of pressure expand into hollow bubbles or "blisters". These blisters cause permanent separation of the roofing plies which can cause weakening and deterioration of the material, eventually resulting in rupture of the plies and leaking of the roof, especially if the roof is subjected to foot traffic, as is often the case. This type of roofing material is commonly used on flat or only slightly sloping roofs, but is sometimes used on roofs having much steeper slopes.

Accordingly, the primary object of the present invention is the provision of a roof ventilator which not only provides the usual attic ventilation, but also prevents the "blistering" of the roofing material itself, as discussed above.

More specifically, an object of the present invention is the provision of a roof ventilator including a conduit interconnected through the roof deck and opening to the atmosphere above the roof, but having a perforated section of said conduit sealed within the thickness of the roofing material applied directly over the deck. Gas becoming pressurized by heat within the roofing material in the vicinity of the ventilator thus moves between the roofing plies and escapes to the conduit through its perforations, and hence to the atmosphere. Therefore, if the ventilators are installed at suitable intervals over the area of the roof, all blistering will be effectively prevented.

Another object is the provision of a roof ventilator of the character described having means for collecting and disposing of liquid moisture tending to collect in the conduit, whether said moisture is formed by condensation during the cool night hours, or is ejected into the conduit from between the plies of the roofing material during the hot daytime hours. If not disposed of, such moisture would drip to the interior ceilings and cause unsightly spotting thereof.

Still another object is the provision of a roof ventilator of the character described which may be completely installed from above the roof, with no access to the attic space between the roof and ceilings. Such attic space is often of very difficult access, or it may be only a few inches high, making access effectively impossible.

Other objects are simplicity and economy of construction, ease and convenience of installation, and efficiency and dependability of operation.

Figure 2:
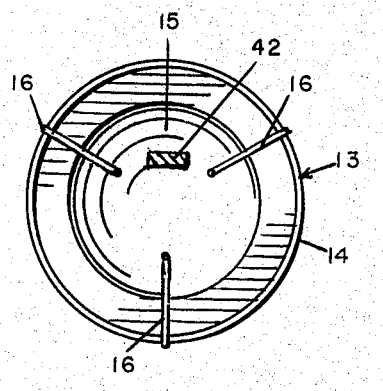
Figure 3:
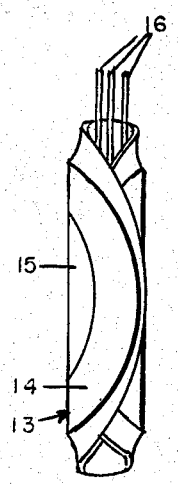

With these objects in view, as well as other objects which will appear in the course of the specification, reference will be had to the accompanying drawing wherein:

FIG. 1 is a generally vertical sectional view through a roof ventilator embodying the present invention, shown operatively installed in a roof structure, FIG. 2 is a sectional view taken on line II—II of FIG. 1, showing the moisture collecting tray, and FIG. 3 is a view of the moisture collecting tray shown rolled for insertion through the ventilator conduit.

Like reference numerals apply to the same parts throughout the drawing views, and the numeral 2 applies to the roof deck, which is commonly formed of either wood or concrete, and which supports the roofing material 4 applied thereover, said roofing material usually being applied over a layer of tar or the like, not shown, first applied to the deck. Said roofing material commonly consists of alternating layers or plies of roofing felt and a bituminous material such as asphalt or the like. Actually, the normal roofing material is only about one-quarter inch thick, including several layers of felt and asphalt. However, in repairing roofs, new layers are often applied over old, without first removing the old layers, with the result that in time the composite thickness of all of the layers may accumulate to two or three inches. The drawing is scaled to illustrate this condition. To ready the roof for installation of the present ventilators, holes 6 (one shown) are bored through deck 2, and any layers of roofing material already in place, at the desired intervals over the area of the roof. The ventilator forming the subject matter of the present invention is indicated generally by the numeral 8, and includes a first pipe nipple 10 having perforations 12 formed therethrough at closely spaced intervals over substantially the entire area of its wall. Nipple 10 has its lower end threaded solidly into a hole 6 of deck 2 so as to communicate with the attic space beneath said deck, and is selected in length to extend somewhat above any layers of roofing material already in place, and also above the new layer of roofing material 4 to be applied. The new layer of roofing material may then be applied, cutting holes therein to fit over the upper ends of nipples 10.

At this time, a moisture collecting tray indicated generally by the numeral 13 should be installed. Said tray is illustrated as circular in form, having a diameter substantially greater than that of deck hole 6. It consists of an annular lipped rim 14 formed of a semi-rigid material, such as a PVC plastic, having sufficient strength to maintain its shape under normal stresses, but being sufficiently flexible to be rolled into generally tubular form as illustrated in FIG. 3, by manual force, and a membrane of flexible material such as the thin rubber normally used in toy balloons secured to said rim to close the central opening thereof, and normally to depend therefrom in the form of a pouch 15. The rim 14 is adapted to be supported in a level plane, just below deck 2, by three pliable strands 16, which may be of nylon or the like to prevent rotting or other deterioration, connected at regular intervals to the lip of the rim 14, said strands being knotted together, and to another similar strand 18, at 20. Strand 18 rises through nipple 10, and has a ring 22 secured to its upper end.

To install the tray from above the roof, it is first manually rolled into generally tubular form, as shown in FIG. 3, with strands 16 projecting from one end of the "tube", and then inserted downwardly through nipple 10 until it passes below roof deck 2, while supporting it by means of strands 16 and 18, and ring 22. The tray recovers resiliently to its normal configuration as soon as it passes below deck 2. A rod 24 having a central offset is then passed through ring 22, and its ends fitted slidably into a pair of horizontally opposed perforations 12 in the upper portion of nipple 10, above the topmost layer of roofing 4. Of course, one end of the rod must be inserted first, and extended outside the nipple, before moving the rod in the opposite direction to engage its opposite end. Ring 22 is engaged in the offset of rod 24, as shown, to maintain the tray in a centered position relative to the nipple.

An annular washer 26 is then applied over the projecting upper end of nipple 10 to rest against roofing material 4, and should be of sufficient diameter to completely cover the hole cut in the roofing material to accomodate the nipple, despite any reasonable inaccuracies in the cutting of said hole. An internally threaded pipe coupling 28 is then applied over the top of nipple 10, and threaded downwardly to engage washer 26 and press it firmly against the roofing material. Care should be exercised, however, not to screw the coupling down too tightly, since this could so compress the roofing material adjacent nipple 10 as to inhibit the free escape of pressurized gases from between the roofing material plies to the nipple. Application of the coupling also closes the outer ends of the perforations 12 in which rod 24 is engaged, so that said rod is locked in place.

A second pipe nipple 30 has its lower end threaded into the upper end of coupling 28, and its upper end is threaded into the central outlet 32 of a horizontal tubular header 34, said header also having a pair of downwardly directed outlets 36 at its respective ends. Each outlet 36 has a mass of foraminous material 38, such as steel wool or screen wire, fitted therein. Said material permits easy passage of air therethrough, but prevents the entry of insects into the header.

A layer 40 of tar, pitch or the like is applied continuously over roofing material 4, also covering washer 26 and coupling 28, preferably high enough to seal the connection between said coupling and nipple 30. A woven wicking strip 42 of textile material is disposed with its lower end in tray pouch 15, and is threaded upwardly through nipple 10, coupling 28, nipple 30 and header 34 to depend from one of its outlets 36, as shown in FIG. 1.

In its operation as an attic vent, hot attic air, which occurs principally during the hot sunlight hours, is carried upwardly by convection through the conduit formed by nipple 10, coupling 28, nipple 30 and header 34 to be discharged to the atmosphere. If air, water vapor or actual liquid moisture trapped in the plies of the roofing material becomes heated to the point of vaporizing and expanding to an extent causing elevated pressures within the plies, the increased pressure of these gases will cause them to flow between the plies, or more accurately within the air-pervious felt plies, to one of the ventilators 8, where they escape into perforated nipple 10 and are also disposed of through the header. Thus, if the ventilators are properly and sufficiently closely spaced apart, no blistering of the roofing material will occur. Since the hot attic air and the highest internal temperatures of the roofing material normally occur during the same hours of a day, it will be seen that the attic ventilating function of the device assists very materially in the ventilation of the roofing material itself. The greatly increased upward flow of attic air through the device assists in the disposition of the roofing gases entering the device, and in the vaporization of any actual liquid moisture expelled into the nipple 10 from the roofing material. The escape of gases from the roofing material is normally so slow as to be ineffective in creating convection flow currents.

However, in some instances liquid moisture expelled from the roofing material into nipple 10 will not be completely vaporized. Also, particularly during the cool night hours of humid days, condensate may tend to form within the ventilator. Water from either of these sources would drip from the lower end of nipple 10, and could reach and damage interior ceilings of the building, were it not for tray 13. This tray catches and collects such moisture. Then, when the hot hours of the next day occur, hot attic air must flow over and around the tray, gradually vaporizing its liquid content and disposing of the vapor through header 34. Wick 42 covers the rare possibility that water might collect in tray 13 more rapidly, and to a greater volume, than it can be disposed of as described, despite the added capacity of said tray provided by its pouch 15. A tray only as deep as rim 14, and having no pouch, would normally suffice. Said wick draws water from the tray continuously, regardless of ordinary temperature changes and convection air currents, and disposes of it through one of header outlets 36.

The device is quite flexible in use and applicable to roofs of many different types. Tray 13, by virtue of its pliable suspension strands 16 and 18, always hangs directly beneath the lower end of nipple 10, so as to be in position to receive water dripping from said nipple even if the roof to which the device is applied should slope to a substantial degree. Nipple 10 should be selected in length to accomodate the thickness of roofing material 4 actually present on the roof, and nipple 30 should be selected in length to dispose the outlets 36 of header 34 above the maximum level of water which might collect on the roof during heavy rainstorms and the like. With these selections, the device may be applied to nearly any roof. In addition to its roof and roofing ventilation functions, the device may serve as a "snow eagle". That is, if the ventilators are arranged along the lower edge of a sloping roof, with headers 34 parallel to the roof edge, they serve to prevent or inhibit the dangerous "avalanching" of accumulated snow from the roof.

While I have shown and described a specific embodiment of my invention, it will be readily apparent that many minor changes of structure and operation could be made without departing from the spirit of the invention.

What I claim as new and desire to protect by Letters Patent is:

1. A roof ventilator for a roof having a layered roofing material applied over a roof deck, said ventilator comprising:

a. a conduit adapted to be secured at its lower end in a hole formed in said deck to communicate with the attic space beneath said deck, and extending upwardly from said deck through said roofing material to a point spaced thereabove, and having an outlet to atmosphere at its upper end, the portion of said conduit disposed within the thickness of said roofing material being perforated to admit gases and vapors escaping from among the layers of said roofing material to said conduit, b. a moisture collecting tray having an area substantially greater than the horizontal area of said conduit, said tray including no material stiffer than a resilient material capable of retaining its form under normal stresses, but sufficiently resiliently flexible to be capable of being rolled to a generally tubular form of sufficiently small diameter to be inserted downwardly through said conduit, whereby to be capable of installation from above the roof, and of recovering resiliently to its normal form after insertion, and, c. means supporting said tray within the attic space, below the lower end of said conduit, whereby to catch and collect any moisture dripping from said conduit.

2. A roof ventilator as recited in claim 1 wherein said tray comprises:

a. an annular rim portion formed of said form-retaining material, and engaged by said tray supporting means, and b. a membrane closing the central aperture of said rim and formed of a pliable material, said membrane forming a pouch depending from said rim, whereby to increase the liquid capacity of said tray.

3. A roof ventilator as recited in claim 1 wherein said tray supporting means comprises a plurality of pliable strands secured to the periphery of said tray at intervals therealong, and extending upwardly into said conduit for attachment thereto, whereby said tray will always be disposed directly beneath the lower end of said conduit, even though said roof deck may be inclined from horizontal.

4. A roof ventilator as recited in claim 3 wherein said conduit includes a first section secured in said roof deck and extending only slightly above said roofing material, all other conduit sections being detachably connected to said first section, and wherein said tray supporting means additionally includes a connector member detachably connected to the upper ends of said pliable tray supporting strands, said connector member being engageable in said first conduit section, adjacent the upper end thereof, whereby said engagement may be made from a position above the roof, after the tray has been rolled and inserted, but before the remaining conduit sections have been connected to said first section.

* * * * *